US006920767B2

(12) United States Patent
Sciacca

(10) Patent No.: US 6,920,767 B2
(45) Date of Patent: Jul. 26, 2005

(54) METHOD AND DEVICE FOR PRODUCING AUTOMATICALLY SHAPED TUBULAR KNITWEAR ITEMS AND PRODUCTS OBTAINED THEREBY

(76) Inventor: Franco Sciacca, Via Veneto, 18—22070, Cassina Rizzardi (Como) (IT)

( * ) Notice: Subject to any disclaimer, the term of this patent is extended or adjusted under 35 U.S.C. 154(b) by 332 days.

(21) Appl. No.: 10/182,693

(22) PCT Filed: Jan. 30, 2001

(86) PCT No.: PCT/IT01/00045

§ 371 (c)(1),
(2), (4) Date: Oct. 18, 2002

(87) PCT Pub. No.: WO01/57298

PCT Pub. Date: Aug. 9, 2001

(65) Prior Publication Data

US 2003/0097860 A1 May 29, 2003

(30) Foreign Application Priority Data

Jan. 31, 2000 (IT) ..... CO2000A0003

(51) Int. Cl.[7] ..... D04B 9/00
(52) U.S. Cl. ..... 66/8
(58) Field of Search ..... 66/8, 17, 19, 81, 66/173, 178 R, 189, 182, 183, 76, 60 R, 185, 184

(56) References Cited

U.S. PATENT DOCUMENTS

| | | | | | |
|---|---|---|---|---|---|
| 4,763,492 | A | * | 8/1988 | Tibbals, Jr. | 66/232 |
| 4,796,444 | A | * | 1/1989 | Tibbals, Jr. | 66/13 |
| 4,811,572 | A | * | 3/1989 | Tibbals, Jr. | 66/13 |
| 5,001,909 | A | * | 3/1991 | Tibbals, Jr. | 66/9 R |
| 5,095,720 | A | * | 3/1992 | Tibbals, Jr. | 66/55 |
| 5,133,196 | A | * | 7/1992 | Tibbals, Jr. | 66/35 |
| 6,460,380 | B1 | * | 10/2002 | Sciacca et al. | 66/21 |
| 6,739,158 | B2 | * | 5/2004 | Sciacca | 66/8 |

* cited by examiner

*Primary Examiner*—Danny Worrell
(74) *Attorney, Agent, or Firm*—James B. Conte; Barnes & Thornburg

(57) ABSTRACT

The invention relates to tubular knitwear items (1) suitably shaped or modeled without the usual cutting and sewing operations and preferably without using elastic yarns. According to the jacquard design and/or to the work cycle of the textile machine, the invention enables the production of differentiated-growth fabric in specific areas or zones by the programmed exclusion of loops or knitted courses and the simultaneous production of exceeding stitches or inner frills (Bi), thus obtaining a programmed three-dimensional deformation of the knitted tube according to manufacturing needs.

10 Claims, 2 Drawing Sheets

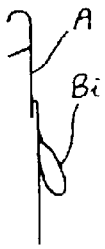
Fig. 1a
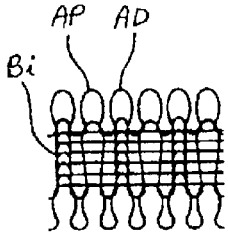
Fig. 1
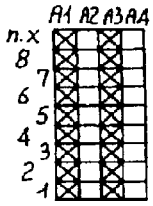
Fig. 2
Fig. 2a A1 maglia-knit A2 briglia-miss
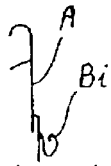
Fig. 1b
Fig. 3
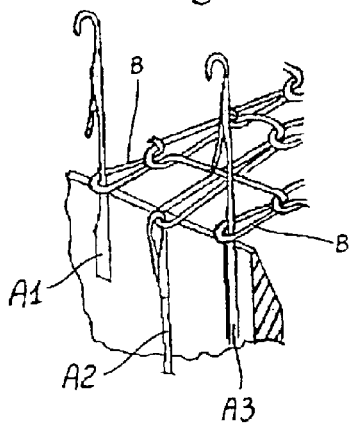
Fig. 6
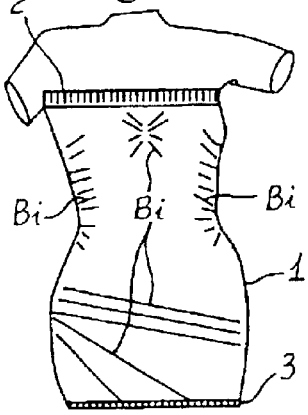
Fig. 5
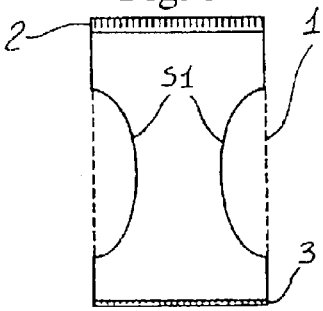
Fig. 4
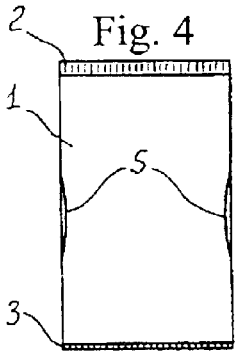
Fig. 7
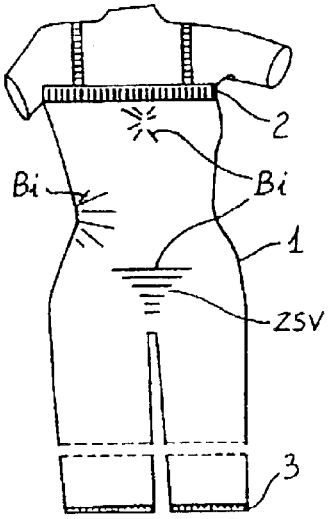
Fig. 8
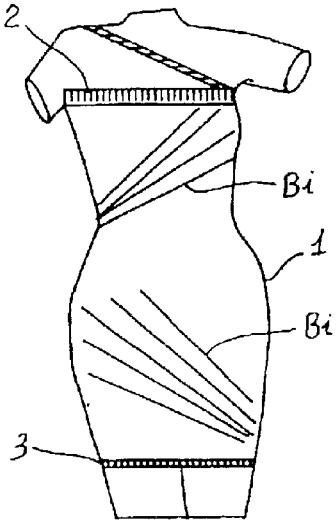
Fig. 9
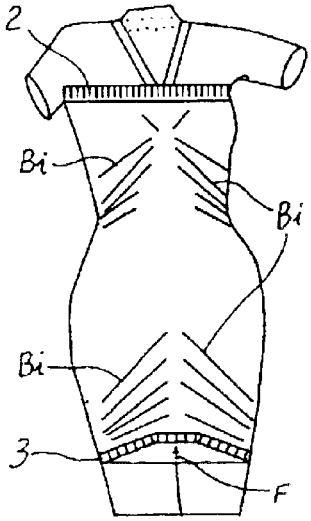

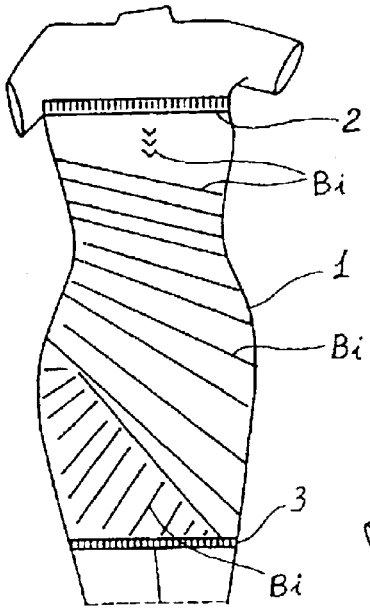
Fig. 10
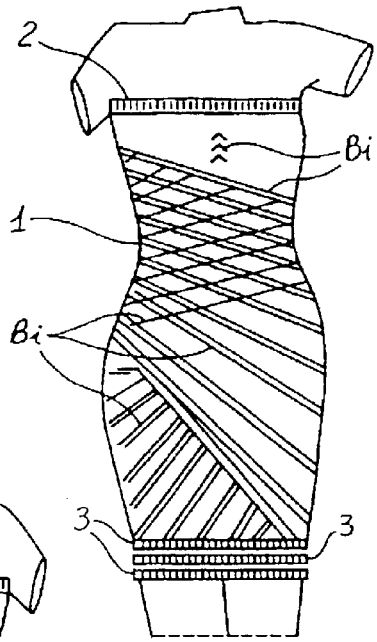
Fig. 12
Fig. 11
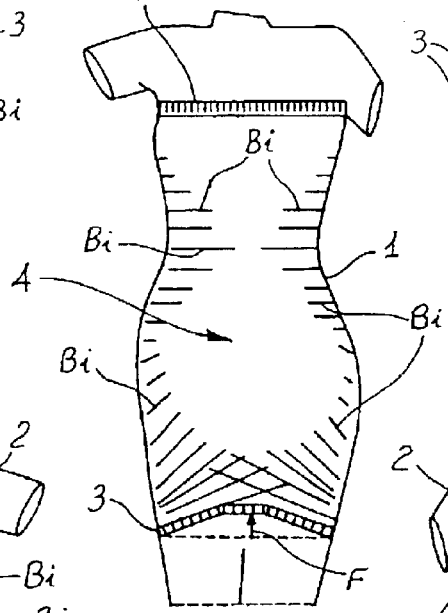
Fig. 13
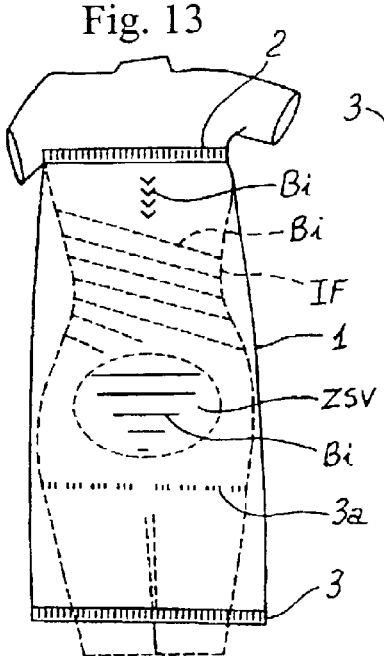
Fig. 14
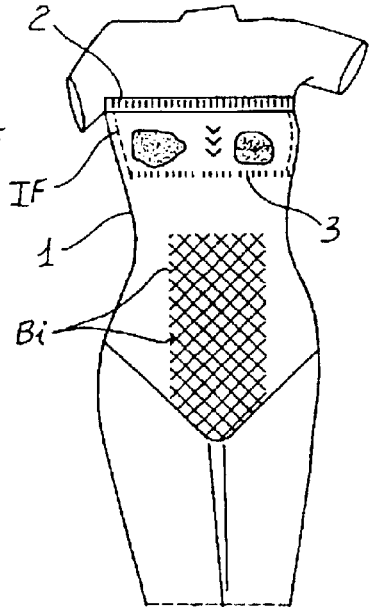

METHOD AND DEVICE FOR PRODUCING AUTOMATICALLY SHAPED TUBULAR KNITWEAR ITEMS AND PRODUCTS OBTAINED THEREBY

TECHNICAL FIELD

The introduction of "full electronic" circular knitting machines with differentiated diameters has attracted the knitting industry's interest since the versatility of these machines allows to produce a wide range of semi-finished tubular items, such as for instance bras, pants, dresses, trousers, skirts, teddies, swimsuits, technical items, and more.

As is generally known, from the technical-textile point of view said items can be modeled or shaped only partly, since current manufacturing techniques, partly incisive, cannot model the various anatomic portions in a complete, pleasant and satisfying way, as is required by the large number of sizes.

This manufacturing difficulty, on the one hand, obliges producers of textile machines to manufacture a large series of tubular machines with very close diameters and fineness degrees, so as to reach a higher precision in the graduation of the final extensibility of the garment, and therefore of the user's comfort.

On the other hand, in order to make up for the reduced capacity of shaping or modeling suitably and automatically said items in various sizes with a reduced number of diameter and fineness degrees, knitwear manufacturers are forced to use very expensive elastomeric yarns to a greater extent, i.e. highly "elastic" yarns which can suitably hug or compress anatomic portions.

The high cost of said yarns permanently and continuously affects general manufacturing costs, and considering the excessive and suffocating compression, above all in hot climates, the solutions offered by said elastomeric yarns is not always optimal.

AIMS OF THE PRESENT INVENTION

The present invention aims at reducing to a high extent or at wholly eliminating some of the above-mentioned technical and manufacturing limitations, so as to produce automatically tubular knitwear items without longitudinal seams, suitably modeled with original economical, technical, aesthetic and commercial purposes.

A main aim of the present invention consists in providing a method for the production of suitably shaped tubular items, automatically produced with the continuous motion of the needle cylinder.

A further aim consists in a method for the production of tubular knitwear items, equipped with one or more internal frills Bi and with two-layer welts or rims.

An additional aim consists in providing a method for the production of tubular items made of two layers or concentric fabrics and produced continuously, both associated to a common welt, even a double one, said welt being produced by means of both the dial or other needle bed, and the selection of alternated needles.

Another aim consists in providing a method for the production of tubular items with two concentric layers, at least one of which has the function of a shaped bra. Further aims result from the description, examples and enclosed drawings, per se or in combination one with the other, together with the final claims.

DISCLOSURE OF THE INVENTION

The above mentioned aims are substantially achieved by a method and device for producing automatically shaped tubular knitwear items, and products obtained thereby, according to the appended claims.

The features of the invention and the advantages deriving thereof are more evident thanks to the following non limiting description of embodiments provided by way of examples, and advantageously apply to most of circular knitting machines.

BRIEF DESCRIPTION OF THE DRAWINGS

The description will be made with reference to the accompanying drawings in which:

FIG. 1 is a front view of a fabric having frills Bi made only with odd needles AD, with even needles AP not operating;

FIG. 1*a* shows a needle A, usually housed within the bed or cylinder (not shown), on whose stem the underlying fabric and the inner frill Bi are still engaged;

FIG. 1*b* is a view similar to FIG. 1*a* with an "open" frill Bi;

FIGS. 2 and 2*a* technically show the technical pattern for the production of the three-dimensional knit frills Bi;

FIG. 3 is a perspective view of the needles carrying out the sequences for the production of knit frills Bi;

FIG. 4 shows a knitted tube scarcely shaped according to the prior art;

FIG. 5 shows a knitted tube strongly shaped;

FIGS. 6 to 12 show different embodiments of women's clothes shaped and conformed to the body by the inner frills Bi, variously arranged;

FIG. 13 shows a garment 1 made of two concentric layers continuously produced;

FIG. 14 shows a swimsuit 1, with two concentric layers only in the upper trunk and breast portion.

DESCRIPTION OF THE ILLUSTRATIVE EMBODIMENTS

The characteristics of the invention and the advantages resulting thereof will be more evident from the following description of embodiments provided by way of example, and can be advantageously applied to the majority of circular machines.

These results can be easily reached according to the invention, and to mere descriptive non-limiting purposes, a great part of the invention relates to a modern circular machine of the "full electronic" type.

The present invention partly refers to the teachings contained in the Italian patent no. 1255008 belonging to the same proprietor, schematically shown in FIGS. 1–2–3. In a few words, said patent relates to the production of circular knitwear items characterized by fabric zones with differentiated growth due to the exclusion of a given number of needles, alternated with respect to the adjacent ones, for instance 1:1, or 2:1–2:2 and the like.

Contrary to the rules, during the fabric-building process a great part of inputs or commands usually directed to the needles is not sent to a part of the latter, following a given pattern or program according to the original design. This results in the exclusion of the needles without inputs or commands from the knitting process: said exclusion, if total and related to specific zones, causes floating yarns instead of the knitted fabric. Said floating yarns are then handled by means of some operating needles A, FIG. 1, suitably spaced, with the double purpose of reducing the length of floating yarns and of creating interesting knitted structures, that is to say the inner three-dimensional frills Bi, FIG. 1. Therefore, the invention is carried out by handling said floating yarns transformed into knitted fabric, the latter being produced only with a part of the needles which are present in the concerned areas or zones. For instance only even needles AP, FIG. 1, will be excluded, or alternated pairs of needles, i.e. three-needle operating groups followed by one or more excluded needles, and so on.

The simultaneous presence of operating needles alternated with excluded needles, (FIGS. 1–3), in specific zones and/or for an even relatively long time (corresponding to a suitable number of knitted courses, FIG. 2), is the sufficient and necessary premise for the manufacture of a particularly knitted fabric, built by operating needles and corresponding loops AD, though interrupted and still crossed to excluded needles and loops AP, so as to produce the closed knitted frill with two layers or cloths Bi, FIG. 1, within the usual knitted tube.

The technical pattern of the frill Bi in FIG. 2 shows that only the odd needles A1, A3 and the following produce fabric, whereas the even ones, A2, A4 and the following are not operating for a large number of courses: from no. 1 to no. x.

The perspective view of FIG. 3 shows the excluded even needles A2, and the following, alternated to the odd needles A1, A3 and the following, with the corresponding last loops or stitches B.

Such fabric growth or additional frill Bi is characterized on the plain side of the knitted fabric by a perfect seam due to the stretching of the loops or stitches of non-operating needles AP, which are therefore excluded from the building process of said frill, whose height and width is repeatable or variable. Said three-dimensional frills Bi are particularly efficient in horizontal and diagonal directions and, if suitably placed or repeated, they can help the support of anatomic portions such as breast, abdomen, glutei.

Generally, a lot of knitted clothes are finished with long cutting operations along pre-established lines and then assembled with difficult and expensive sewing operations. On the other hand, some of the tubular items mentioned in the introduction are shaped to a small extent by using different structures and fabric thicknesses, so as to define one or more fabric portions or zones with respect to others, i.e. to suit them as much as possible to the shape of the human body.

In the example known from the prior art shown in FIG. 4, the initial knitted tube 1, provided with a double welt with two layers 2 and 3, produced without using elastomeric yarns, is shaped to a limited extent by using different structures and fabric thicknesses along the hatched areas indicated with S.

In the following FIG. 5 the knitted tube shows bents or strongly accentuated or modeled areas, indicated with S1, which can be usually obtained by means of cutting and sewing operations, or by using so-called elastic yarns. In a first preferred embodiment the invention is firstly implemented by preparing a work cycle or jacquard design, i.e. direct and/or precluded inputs to needles and/or jacks and/or other elements contributing directly or indirectly to the knitting process, by means of a suitable graphics workstation and/or control and/or storage devices, or by means of electromechanical, magnetic, optical apparatus, and other similar means suitable to said purpose. According to the invention the knitted tube 1 of FIG. 6 begins in a known way from the double welt 2 with a continuous selection of alternated needles, for instance the odd ones, or with all needles in an operating status and with the help of the jacks of the dial (not shown).

After completing said double welt by releasing the dial hooks or the stitch seam by operating the previously excluded needles, e.g. the even ones, production goes on in a usual way for a suitable number of knitted courses, preferably of jersey fabric.

On the breast, according to the jacquard design and its corresponding program or work cycle, the textile machine produces fabric with differentiated growth, said fabric being characterized by symmetrical horizontal and/or diagonal lines formed by inner frills Bi, already shown in FIG. 1, so as to define and shape the knitted cups for the breasts and to gradually reduce the diameter of the knitted tube.

In practice, the knitting process is characterized by the simultaneous production of loops or single stitches contributing to the formation of the knitted tube, variously interrupted by loops or stitches contributing only to the production of said inner frills Bi. FIG. 6 shows along the trunk and back a series of frills Bi with variable width and depth, which can suitably reduce the fabric growth so as to shape it to the small size of the waist or belt.

Towards the pelvis said frills Bi tend to decrease until they completely disappear. The production of item 1 goes on with a suitable number of knitted courses and the remaining frills Bi on the legs have mainly aesthetic functions. Eventually, the manufactured item 1 is completed with a double welt 3 in the usual way.

According to the invention the programmed interruption of the fabric-building process by a part of the cylinder needles on knitted courses or ribs, i.e. on pre-established knitted zones or areas, causes the structural "deformation" of the knitted tube according to the jacquard design or set work cycle.

The tubular knitwear item 1 of FIG. 7, in which the trouser is obtained by the following cutting/sewing operation, is produced with a machine having a more suitable diameter and/or fineness, and therefore it does not require any excessive shaping operations, thus obtaining the necessary narrowing on the belt with a reduced use of frills Bi. To additional purposes, i.e. to increase a well-defined anatomic comfort, it is provided for the frills Bi, which are also indicated with ZSV in the abdomen area.

In the embodiment of FIG. 8 the knitwear item 1 is obtained by the usual initial knitted tube provided with the usual double welts, also elastic welts 2 and 3. According to the invention said knitted tube is shaped or modeled by means of long diagonal frills Bi, suitably arranged, which also have an important aesthetic and commercial function.

The embodiment shown in FIG. 9 is a garment 1 largely characterized by the use of frills Bi, which, suitably arranged, also purposely lift a portion of the lower welt 3, indicated with arrow F. Considering the variants resulting from productive or technical-textile factors, the upper welt 2 can also be lowered, a satisfying result obtained without the usual expensive cutting-sewing operations.

In FIGS. 10–11–12 the very tight dress 1 is variously characterized by the presence and arrangement of frills Bi. According to the invention it is possible not only to vary to a wide extent the degree of adherence of the clothes produced, but the programmed structural deformation of the knitted tube is integrated, when necessary, by the stylistic search for a pleasant arrangement of said frills, with the advantageous result of integrating useful and functional aspects according to commercially appreciable aesthetic criteria. The above-mentioned figures show the clothes indicated with 1 in aesthetically and functionally different embodiments.

For instance, in FIG. 12 the large number of frills Bi placed on the back increase the degree of local compression, whereas in FIG. 11 the part indicated with 4 is made of jersey fabric with a higher degree of elasticity and more shaped than the adjacent areas, which are characterized by a large number of frills Bi.

The garment of FIG. 12 is particularly characterized by a plurality of suitably arranged frills and by a triple lower double welt 3.

FIG. 13 shows another knitwear item falling within the framework of the invention: the tubular item 1 is made of two concentric fabrics joined by a common double welt 2. The manufacturing process normally begins from the inner double welt 3A, and therefore from the inner fabric IF, and goes on as far as the upper double welt 2, obtained by means of the dial jacks or alternated needles only. After releasing the said jacks, the knitting process goes on with the production of the outer fabric 1 as far as the lower double welt 3.

The outer fabric 1 is wider and may have a different length, color, yarn, structure (also with open work) and/or double welt 3, and it covers, even only partially, the underlying inner fabric, or vice versa.

In further detail, the inner fabric IF, having the function of a teddy, is characterized by a usual initial double welt 3A with variable height, if necessary joined or sewn on the crutch, followed by a suitable number of knitted courses as far as the series of frills Bi for compression or abdominal support ZSV.

From the hips and as far as the upper double welt 2 the inner knitted tube IF undergoes first a rapid narrowing and then a gradual and continuous widening to shape the upper portion of the trunk, both effects being due to the large number of long frills Bi suitably arranged.

Eventually, small frills Bi are placed between and around the breasts to shape the breast. The framework of the present invention also includes the knitwear item shown in FIG. 14, which schematically shows a swimsuit 1 provided with the upper double welt 2 directly connected to the inner knitted fabric IF having functions of a shaped bra with a plurality of frills Bi, which are present on the whole item.

Also in this case the manufacturing process preferably, though not necessarily, begins from the double welt 3 and goes on producing the inner fabric IF as far as the upper double welt 2; therefore, after the usual release of the dial's jacks the fabric goes on and ends on the inguinal portion.

After the knitting stage, the inner part IF, i.e. the shaped bra, is bent inwards, so that the resulting knitwear item is made of two partially overlapping concentric fabrics.

The large number of frills Bi, beyond resulting in the desired anatomic conformation, greatly contributes to improve the final aspect of the item.

With particular reference to the tubular items shown in FIGS. 13 and 14, considering fashion trends and other factors which often change consumers' tastes, the invention also describes and claims the implementation of knitwear items, even of the inside-out type, i.e. designed and carried out so as to stress the three-dimensional effects of the so-called inner frills Bi, which, placed outside and possibly also opened or crumpled, FIG. 1B, produce an original variety of textile, aesthetic and functional effects.

The opened frill Bi is obtained when, at the end of said frill, the corresponding needles discharge the last loops and the fabric therefore tends to close or crumple on itself.

With reference to tubular items with two concentric layers, the invention also claims its different use, characterized in that said items can be worn and shown both normally and inside out, an important detail from the technical-textile point of view, above all in presence of fabric produced with colored yarns and with the plating or "vanisé" technique, or if one wants to stress the transparent effect between the bottom fabric IF, which is substantially different from the one lying above as far as yarn, color or structure are concerned, and the top fabric being made, also partially, of so-called "open-work" or transparent yarns and/or structures.

The present description, though necessarily limited, provides people skilled in the art with wide possibilities of improvement all falling within the framework of the invention.

What is claimed is:

1. A method for producing automatically shaped tubular knitwear items (1) in circular knitting machines, said machines having at least a needle-bed, said method comprising:

producing a first length of tubular knitted fabric having a cylindrical shape and ending with a last knitted course;

excluding from the knitting process a predetermined number of needles (A);

choosing said number of needles according to a predetermined sequence from at least a first portion of said needle-bed, said number of needles corresponding to a first portion of knitted tube;

producing a second length of tubular fabric to include at least a first portion of knitted tube to have a differentiated growth of knitted courses and loops with exceeding stitches or inner frills (Bi);

producing a second portion of knitted tube;

corresponding said second length of tubular knitted fabric during said production to said first portion of said needle bed;

obtaining a programmed three-dimensional deformation of knitted tube;

reintroducing, after a predetermined time interval, said predetermined number of needles (A) of the needle-bed in the knitting process and producing a third length of tubular knitted fabric;

continuously moving the needle cylinder during production of said length of tubular items;

shaping and modeling said tubular items without standard cutting and sewing operations and without using elastic yarns;

excluding inputs or commands normally directed to the needles during said production of said tubular items;

maintaining said production in accordance with a jacquard design and/or work cycle of said knitting machine.

2. A method for producing automatically shaped tubular knitwear items (1) in circular knitting machines, said machines having at least a needle-bed, said method comprising:

producing a first length of tubular knitted fabric having a cylindrical shape and ending with a last knitted course;

excluding from the knitting process a predetermined number of needles (A);

choosing said number of needles according to a predetermined sequence from at least a first portion of said needle-bed, said number of needles corresponding to a first portion of knitted tube;

producing a second length of tubular fabric to include at least a first portion of knitted tube to have a differentiated growth of knitted courses and loops with exceeding stitches or inner frills (Bi);

producing a second portion of knitted tube;

corresponding said second length of tubular knitted fabric during said production to said first portion of said needle bed;

obtaining a programmed three-dimensional deformation of knitted tube;

reintroducing, after a predetermined time interval, said predetermined number of needles (A) of the needle-bed in the knitting process and producing a third length of tubular knitted fabric;

continuously moving the needle cylinder during production of said length of tubular items;

shaping and-modeling said tubular items without standard cutting and sewing operations and without using elastic yarns;

producing said knitted courses at least partly according to a design or pattern and corresponding work cycle in which alternating even needles of the needles (AP) are excluded from said knitting process, while other alternating odd needles (AD) are still operated;

maintaining said production in accordance with a jacquard design and/or work cycle of the knitting machine; and wherein said knitted items (1) are characterized by an initial double welt (2) followed by a number of knitted courses which extend to a second double welt (3), said courses followed by a final waist.

3. A method for producing automatically shaped tubular knitwear items (1) in circular knitting machines, said machines having at least a needle-bed, said method comprising:

producing a first length of tubular knitted fabric having a cylindrical shape and ending with a last knitted course;

excluding from the knitting process a predetermined number of needles (A);

choosing said number of needles according to a predetermined sequence from at least a first portion of said needle-bed, said number of needles corresponding to a first portion of knitted tube;

producing a second length of tubular fabric to include at least a first portion of knitted tube to have a differentiated growth of knitted courses and loops with exceeding stitches or inner frills (Bi);

producing a second portion of knitted tube;

corresponding said second length of tubular knitted fabric during said production to said first portion of said needle bed;

obtaining a programmed three-dimensional deformation of knitted tube;

reintroducing, after a predetermined time interval, said predetermined number of needles (A) of the needle-bed in the knitting process and producing a third length of tubular knitted fabric;

continuously moving the needle cylinder during production of said length of tubular items;

shaping and modeling said tubular items without standard cutting and sewing operations and without using elastic yarns;

corresponding needles (A) to the end of said frills (Bi);

completely discharging the last loops of the frills (Bi) from said needles (A) corresponding to said end of said frills;

maintaining said production in accordance with a jacquard design and/work cycle of the knitting machine.

4. A method for producing automatically shaped tubular knitwear items (1) in circular knitting machines, said machines having at least a needle-bed, said method comprising:

producing a first length of tubular knitted fabric having a cylindrical shape and ending with a last knitted course;

excluding from the knitting process a predetermined number of needles (A);

choosing said number of needles according to a predetermined sequence from at least a first portion of said needle-bed, said number of needles corresponding to a first portion of knitted tube;

producing a second length of tubular fabric to include at least a first portion of knitted tube to have a differentiated growth of knitted courses and loops with exceeding stitches or inner frills (Bi);

producing a second portion of knitted tube;

corresponding said second length of tubular knitted fabric during said production to said first portion of said needle bed;

obtaining a programmed three-dimensional deformation of knitted tube;

reintroducing, after a predetermined time interval, said predetermined number of needles (A) of the needle-bed in the knitting process and producing a third length of tubular knitted fabric;

continuously moving the needle cylinder during production of said length of tubular items;

shaping and modeling said tubular items without standard cutting and sewing operations and without using elastic yarns;

turning said knitwear items inside out so as to stress the three dimensional affects of inter frills (Bi).

5. A method for producing automatically shaped tubular knitwear items (1) in circular knitting machines, said machines having at least a needle-bed, said method comprising:

producing a first length of tubular knitted fabric having a cylindrical shape and ending with a last knitted course;

excluding from the knitting process a predetermined number of needles (A);

choosing said number of needles according to a predetermined sequence from at least a first portion of said needle-bed, said number of needles corresponding to a first portion of knitted tube;

producing a second length of tubular fabric to include at least a first portion of knitted tube to have a differentiated growth of knitted courses and loops with exceeding stitches or inner frills (Bi);

producing a second portion of knitted tube;

corresponding said second length of tubular knitted fabric during said production to said first portion of said needle bed;

obtaining a programmed three-dimensional deformation of knitted tube;

reintroducing, after a predetermined time interval, said predetermined number of needles (A) of the needle-bed in the knitting process and producing a third length of tubular knitted fabric;

continuously moving the needle cylinder during production of said length of tubular items;

shaping and modeling said tubular items without standard cutting and sewing operations and without using elastic yarns;

forming said knitted item to have a top or outer fabric layer, and an underlying layer, said top or outer layer is comprised of different material than said underlying material.

6. The method according to claim 3, characterized in that the discharge of the last loops on part of the needles (A) is carried out only progressively in at least a feed without yarn, at least temporarily.

7. The method according to claim 3, characterized in that the fabric-building process of the excluded needles (A) is preceded by the intervention of latch-opening devices and begins again only progressively with selected alternated needles (A), in at least a feed with yarn.

8. The knitwear item (1) according to claim 1 characterized by the presence of two preferably concentric layers, joined by at least a common double welt (2), also closed by releasing loops with needles (A) or jacks housed in the dial.

9. The knitwear item (1) according to claim 1 characterized by the presence of at least one, upper and lower, rims or welts (3).

10. The knitwear item (1) according to claim 1 having two layers of variable length, characterized by the simultaneous presence of front and reverse knitted zones, also produced with colored yarns and by using the plating or "vanisé" technique.

* * * * *